US006897605B2

(12) United States Patent
Roh

(10) Patent No.: US 6,897,605 B2
(45) Date of Patent: May 24, 2005

(54) CATHODE ASSEMBLY AND COLOR PICTURE TUBE UTILIZING THE SAME

(75) Inventor: Byoung-Kon Roh, Ulsan Metropolitan (KR)

(73) Assignee: Samsung SDI Co., Ltd., Suwon-si (KR)

( * ) Notice: Subject to any disclaimer, the term of this patent is extended or adjusted under 35 U.S.C. 154(b) by 321 days.

(21) Appl. No.: 10/265,434

(22) Filed: Oct. 7, 2002

(65) Prior Publication Data

US 2003/0094888 A1 May 22, 2003

(30) Foreign Application Priority Data

Oct. 8, 2001 (KR) ..... 2001-61861

(51) Int. Cl.[7] ..... H01J 29/02; H01J 29/48
(52) U.S. Cl. ..... 313/446; 313/417; 313/270
(58) Field of Search ..... 313/346 R, 337, 313/409, 345, 446–447, 412, 414, 417, 477 HC, 451, 292, 270, 456

(56) References Cited

U.S. PATENT DOCUMENTS 3,728,861 A * 4/1973 Fletcher et al. ..... 60/202
5,099,170 A 3/1992 Koizumi
6,130,499 A * 10/2000 Koizumi et al. ..... 313/314
6,242,852 B1 * 6/2001 Nakamura et al. ..... 313/270
6,531,813 B1 * 3/2003 Koizumi et al. ..... 313/446

FOREIGN PATENT DOCUMENTS

JP 2001256896 A * 9/2001 ..... H01J/29/04

* cited by examiner

*Primary Examiner*—Ashok Patel
*Assistant Examiner*—Karabi Guharay
(74) *Attorney, Agent, or Firm*—Robert E. Bushnell, Esq.

(57) ABSTRACT

A cathode assembly includes an insulation member, three holders arranged inline in the insulation member, and a support member having a rim portion in which the insulation member is inserted and supported. When a thickness of the insulation member is D millimeters (mm) and a height of the support member is F millimeters (mm), values of D and F are set to satisfy the following inequality: F/D<170%.

20 Claims, 2 Drawing Sheets

CATHODE ASSEMBLY AND COLOR PICTURE TUBE UTILIZING THE SAME

CLAIM OF PRIORITY

This application makes reference to, incorporates the same herein, and claims all benefits accruing under 35 U.S.C. §119 from my application THE CATHODE ASSEMBLY AND COLOR PICTURE TUBE UTILIZING THE SAME filed with the Korean Industrial Property Office on 8 Oct. 2001 and there duly assigned Serial No. 61861/2001.

BACKGROUND OF THE INVENTION

1. Technical Field

The present invention relates to an electron gun, and more particularly, to a cathode assembly forming an electron emission source and an inline electron gun for a color picture tube using the cathode assembly.

2. Related Art

Typically, an electron gun for a color picture tube is installed at a neck portion of a cathode ray tube and emits an electron beam to excite a fluorescent film. An electron gun for a color picture tube includes a cathode assembly, a control electrode installed adjacent to the cathode assembly, a screen electrode. The electron gun also includes a plurality of focus electrodes installed sequentially in a direction away from the screen electrode.

In the electron gun for a color picture tube having the above structure, as a predetermined electric potential is applied to each of the electrodes, an electron beam is emitted from electron emission substance of the cathode assembly. The emitted electron beam is focused and accelerated by an electron lens formed between the respective electrodes and selectively deflected according to the position of scanning of a fluorescent film, thus landing onto a fluorescent film.

In the above electron gun, the cathode assembly as an electron emission source should have a thermal and structural stability and exhibit a superior assembly feature and a superior welding feature with respect to a metal tape to be described later.

A cathode support frame can include glass and pipes installed inline at the glass. The pipes are exposed to facilitate welding between the pipes and a metal tape. However, when metal tape is welded to the pipes, cracks are generated in the glass due to a pressing force of a welding rod and due to an inferior assembly.

It would be beneficial to minimize the cracks or eliminate the cracks, and it would be beneficial to develop an improved assembly with improved welding characteristics. Efforts have been made to improve cathode supporting structures. An exemplar of a recent effort in the art is as follows: U.S. Pat. No. 5,099,170 for CATHODE SUPPORTING STRUCTURE FOR COLOR CATHODE RAY TUBE issued on 24 Mar. 1992.

While that recent effort pertains to cathode supporting structures, it is not believed to adequately provide an improved, efficient, and convenient cathode assembly and color picture tube utilizing the same.

SUMMARY OF THE INVENTION

To solve the above-described problems and others, it is an object of the present invention to provide a cathode assembly in which welding between a holder fixed to an insulation member and a metal tape is easy.

To solve the above-described problems and others, it is a further object of the present invention to provide a cathode assembly in which a support strength of the insulation member is structurally improved, and an electron gun for a color picture tube using the cathode assembly.

To solve the above-described problems and others, it is a further object of the present invention to provide an electron gun for a color picture tube using the cathode assembly of the present invention.

To achieve the above objects and others, there is provided a cathode assembly comprising an insulation member, at least one holder arranged inline in the insulation member, and a support member having a rim portion in which the insulation member is inserted and supported, wherein, when a thickness of the insulation member is D millimeters (mm) and a height of the support member is F millimeters (mm), values of D and F are set to satisfy an inequality such that $F/D<170\%$.

To achieve the above objects and others, there is provided a cathode assembly comprising an insulation member, three holders arranged inline in the insulation member, and a support member having a rim portion in which the insulation member is inserted and supported, wherein, assuming that a thickness of the insulation member is D millimeters (mm) and a height of the support member is F mm, values of D and F are set to satisfy an inequality that $F/D<170\%$.

It is preferred in the present invention that, when a height of the entire assembly including the holders supported by the insulation member and protruding to the front and rear sides is C millimeters (mm), an inequality that $15\%<D/C$ is satisfied.

In the above cathode assembly, by minimizing the width of the support member, a holder portion which is not buried in the insulator member protrusions over 1 millimeter (mm) from an end portion of the support member so that an area for welding of the metal tape can be secured.

To achieve the above objects and others, there is provided a cathode assembly comprising an insulation member three holders arranged inline in the insulation member, and a support member having a rim portion in which the insulation member is inserted and supported, wherein, when a thickness of the insulation member is D millimeters (mm), a height of the support member is F mm, and a height of the entire assembly including the holders supported by the insulation member and protruding to the front and rear sides is C mm, values of C, D and F are set to satisfy the following inequalities:

$F/D<170\%$ $15\%<D/C$ $29\%\leqq F/C\leqq 70\%$

To achieve the above objects and others, there is provided an electron gun for a color picture tube including a cathode assembly which is an electron emission source, a control electrode and a screen electrode sequentially installed from the cathode assembly and forming a triode portion, and a plurality of focus electrodes installed adjacent to the screen electrode and forming an auxiliary lens and a main lens, wherein the cathode assembly comprises an insulation member, three holders arranged inline in the insulation member, and a support member having a rim portion in which the insulation member is inserted and supported, wherein, when a thickness of the insulation member is D millimeters (mm) and a height of the support member is F mm, values of D and F are set to satisfy an inequality such that $F/D<170\%$.

To achieve these and other objects in accordance with the principles of the present invention, as embodied and broadly described, the present invention provides a cathode assembly, comprising: an insulation member having a thickness; at least one holder being arranged inline in the insulation member; and a support member having a rim portion receiving and supporting said insulation member, said support member having a height, the height of said support member divided by the thickness of said insulating member being less than 1.70.

The present invention is more specifically described in the following paragraphs by reference to the drawings attached only by way of example. Other advantages and features will become apparent from the following description and from the claims.

BRIEF DESCRIPTION OF THE DRAWINGS

In the accompanying drawings, which are incorporated in and constitute a part of this specification, embodiments of the invention are illustrated, which, together with a general description of the invention given above, and the detailed description given below, serve to exemplify the principles of this invention.

DETAILED DESCRIPTION OF THE INVENTION

While the present invention will be described more fully hereinafter with reference to the accompanying drawings, in which preferred embodiments of the present invention are shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Illustrative embodiments of the invention are described below. In the interest of clarity, not all features of an actual implementation are described. In the following description, well-known functions, constructions, and configurations are not described in detail since they could obscure the invention with unnecessary detail. It will be appreciated that in the development of any actual embodiment numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill having the benefit of this disclosure.

Figure 1:
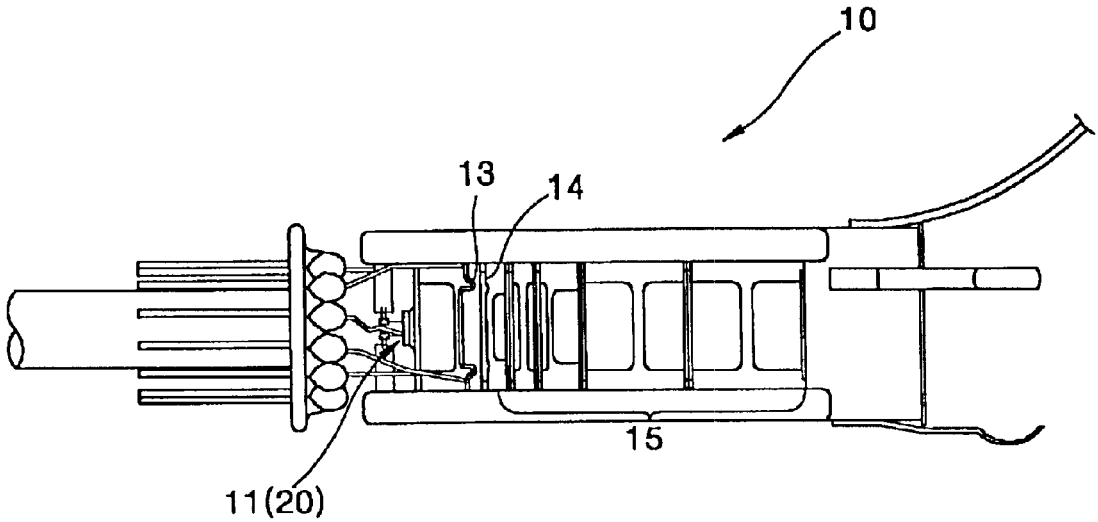
FIG. 1 is a side view showing an electron gun for a color picture tube.

FIG. 1 is a side view showing an electron gun for a color picture tube. Typically, an electron gun for a color picture tube is installed at a neck portion of a cathode ray tube and emits an electron beam to excite a fluorescent film. As shown in FIG. 1, an electron gun 10 for a color picture tube includes a cathode assembly 20, a control electrode 13 installed adjacent to the cathode assembly 20, a screen electrode 14, and a plurality of focus electrodes 15 sequentially installed from the screen electrode 14.

In the electron gun 10 for a color picture tube having the above structure, as a predetermined electric potential is applied to each of the electrodes, an electron beam is emitted from electron emission substance of the cathode assembly 20. The emitted electron beam is focused and accelerated by an electron lens formed between the respective electrodes and selectively deflected according to the position of scanning of a fluorescent film, thus landing onto a fluorescent film.

In the above electron gun, the cathode assembly 20 as an electron emission source should have a thermal and structural stability and exhibit a superior assembly feature and a superior welding feature with respect to a metal tape to be described later.

Figure 2:
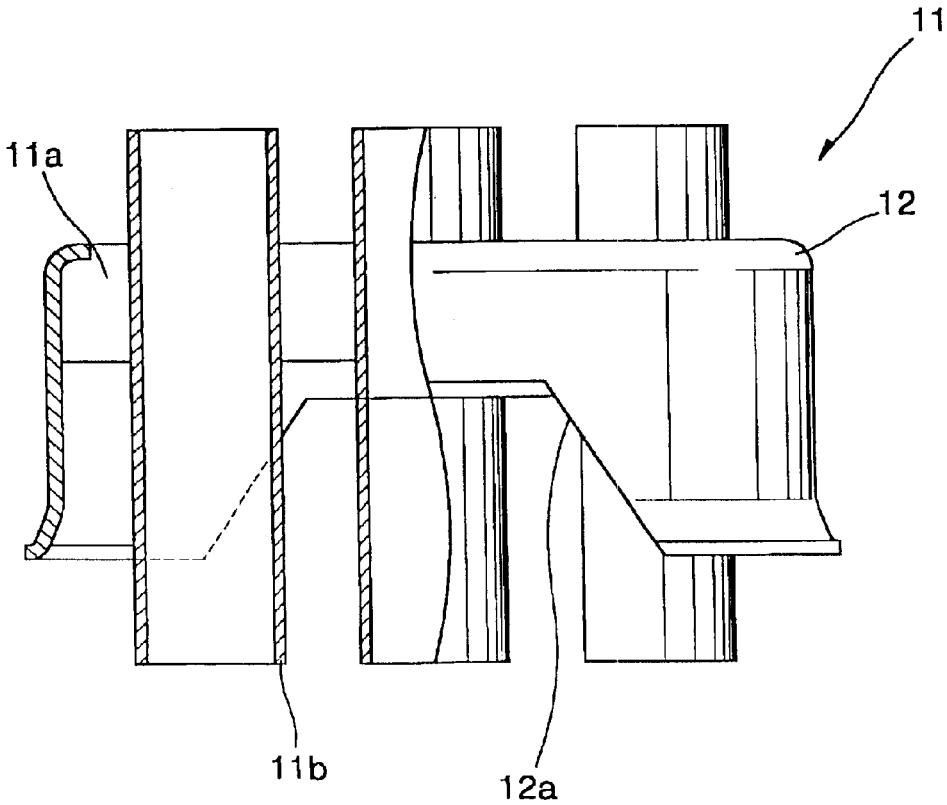
FIG. 2 is a partially cut-away plan view showing a cathode assembly.

FIG. 2 is a partially cut-away plan view showing a cathode assembly. FIG. 2 shows a cathode assembly that does not conform to the principles of the present invention. A cathode support frame 11 is shown in FIG. 2. The cathode support frame 11 is located on the electron gun 10 at the location of the cathode assembly 20 shown in FIG. 1. Referring to FIG. 2, a cathode support frame 11 includes a glass 11*a* and three pipes 11*b* installed inline at the glass 11*a*. The cathode support structure 11 has an outside support frame 12 for supporting the glass 11*a* by encompassing the glass 11*a* in which a notch portion 12*a* is provided at the lengthy side thereof. In the cathode support frame 11 having the above structure, since the notch portion 12*a* is formed at the outside support frame 12, the pipes 11*b* are exposed so that welding between the pipes 11*b* and a metal tape (not shown in FIG. 2) is made easy. However, a support force of the glass 11*a* in a vertical direction by the outside support frame 12 is weak. Thus, when the metal tape is welded to the pipes 11*b*, cracks are generated in the glass 11*a* due to a pressing force of a welding rod. Metal tape 40 is shown in FIG. 3.

An electron gun installed at a neck portion of a color picture tube according to the present invention, as shown in FIG. 1, includes a cathode assembly 20 forming an electron emission source, a control electrode 13 and a screen electrode 14 sequentially installed from the cathode assembly 20 and forming a triode portion, and a plurality of focus electrodes 15 sequentially installed from the screen electrode 14 and forming an auxiliary lens and a main lens.

Figure 3:
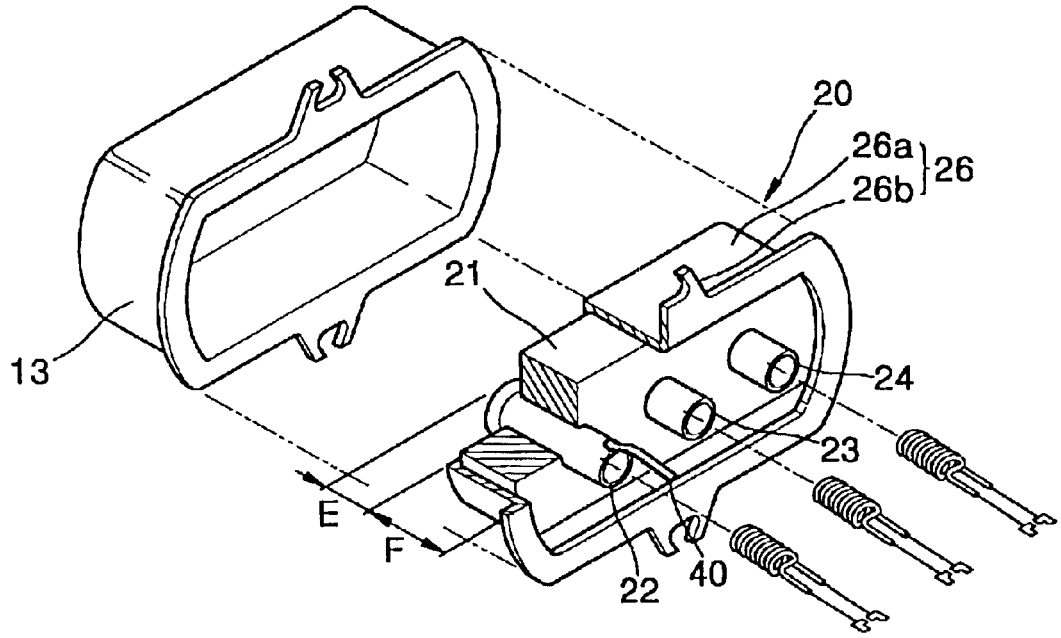
FIG. 3 is an exploded perspective view of a cathode assembly, in accordance with the principles of the present invention.
Figure 4:
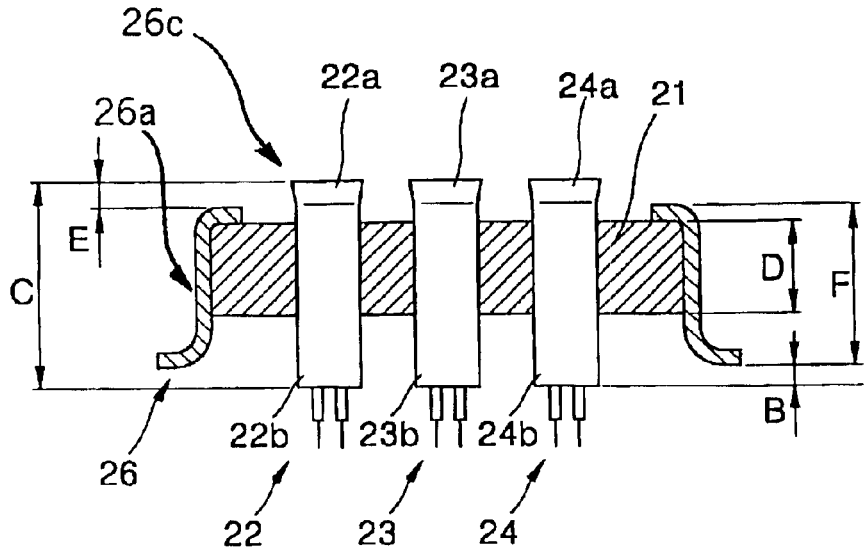
FIG. 4 is a sectional view showing an insulation member and a support member shown in FIG. 3, in accordance with the principles of the present invention.

FIG. 3 is an exploded perspective view of a cathode assembly, in accordance with the principles of the present invention. FIG. 4 is a sectional view showing an insulation member and a support member shown in FIG. 3, in accordance with the principles of the present invention.

In the electron gun having the structure in accordance with the principles of the present invention, as shown in FIGS. 3 and 4, the cathode assembly 20 can be coupled to the control electrode 13 which is a rim electrode. However, the present invention is not limited thereto and a plate control electrode can be installed to be adjacent to the cathode assembly.

The cathode assembly includes three electron emission sources installed inline or to be a dot shape for an electron gun adopted in a color picture tube for realizing a color image, and one electron emission source when it is adopted in a picture tube to realize a black and white image. In a preferred embodiment of the present invention, a cathode assembly for realizing a color image will be shown by the following description.

The cathode assembly 20 includes an insulation member 21 and three cylindrical holders 22, 23, and 24 arranged inline in the insulation member 21. Front protrusions 22*a*, 23*a*, and 24*a*, each having a tip portion opening widely, and rear protrusions 22*b*, 23*b*, and 24*b*, protruding to the rear of the insulation member 21 and where a metal tape 40 is welded, are provided at either end portion of the respective holders 22, 23, and 24. Each of the holders 22, 23, and 24 may have different diameters in the lengthwise direction thereof and be stepped.

The insulation member 21 for fixing the holders 22, 23, and 24 has a support member 26 which has a rim portion 26*a* encompassing the outer circumferential surface of the insulation member 21 and a fixed portion 26*b* bent from the rear end portion of the rim portion 26*a*. An opening 26*c* is formed at the front side of the rim portion 26*a* so that the front protrusions 22*a*, 23*a*, and 24*a* of the three holders 22, 23, and 24 can protrude. The front protrusions 22*a*, 23*a*, and 24*a* penetrate the aperture 26*c*. The insulation member 21 is formed of ceramic, but is not limited thereto. Any structure which can electrically insulate the holders 22, 23, and 24 from the support member 26 is possible.

In the cathode assembly 20 having the above structure, assuming that the thickness of the insulation member 21 is D millimeters (mm) and the height of the support member 26 is F millimeters (mm), the values of D and F are determined to satisfy the following inequality: F/D<170%. When this inequality is expressed as a percentage, it is shown as F/D<170%. Otherwise, this inequality is shown as F/D<1.7.

When the ratio of D/F is too low, cracks are generated in the insulation member 21 so that a shock noise problem occurs. In accordance with the principles of the present invention, strength is defined as a force that generates cracks in the insulation member 21 when the holder supported by the insulation member 21 is crushed by pressing the holder in the lengthwise direction. According to experiments performed by the subject inventor, strength according to the value of F/D can be obtained as shown in the following Table 1.

TABLE 1

| F(mm)/D(mm) in percentage | 100% | 103% | 111% | 121% | 135% | 156% | 170% | 190% | 210% |
|---|---|---|---|---|---|---|---|---|---|
| Strength (kg · f/mm$^2$) | 20 | 20 | 20 | 20 | 15 | 10 | 5 | 3 | 3 |

As can be seen from Table 1, the strength of the insulation member 21 is sharply reduced when the F/D is 170%. Since an actual force applied to the insulation member 21 when the metal tape 40 is welded to the respective holders 22, 23, and 24 is about 5 kg·f/mm$^2$, if the value of F/D is over 170%, it can be seen that crystalline glass is broken by the force applied during the welding.

In the meantime, in the manufacture of the insulation member 21 and the support member 26, it is preferable to set the height F of the support member 26 to 2.0 millimeters (mm) through 3.0 mm and the thickness D of the insulation member 21 to 1.0 mm through 3.0 mm. When the thickness D of the insulation member 21 is less than or equal to 1.0 mm, a support force is decreased so that cracks are easily generated by a small impact. When the thickness D of the insulation member 21 is greater than or equal to 3.0 mm, although a structural strength is sufficiently secured, a manufacture cost increases. In particular, when the thickness D of the insulation member 21 is greater than or equal to 3.0 mm, as outgasing increases, the lifespan of the cathode assembly 20 is curtailed.

Assuming that the height of the entire assembly including the holders 22, 23, and 24 protruding from the front and rear protrusions 22*a*, 23*a*, and 24*a* and 22*b*, 23*b*, and 24*b* is C, values of D and C are set to satisfy an inequality, 15%<D/C. Preferably, the values of D and C are set to satisfy an inequality, 15%<D/C≦60%. When this inequality is expressed as a percentage, it is shown as 15%<D/C≦60%. Otherwise, this inequality is shown as 0.15<D/C≦0.60.

The above setting of values of D and C is to maintain a state in which the holders 22, 23, and 24 are supported by the insulation member 21. Preferably, the height C of the entire assembly is set to be between 5.0 through 7.0 millimeters (mm). The distance B is measured from the rear end portion of the support member 26 to the rear protrusions 22*b*, 22*c*, and 22*d*.

When the height of C is less than or equal to 5.0 mm, it is difficult to secure a distance B (mm) from the rear end portion of the support member 26 to the rear protrusions 22*b*, 22*c*, and 22*d*. When the height of C of is greater than or equal to 7.0 mm, it is difficult to design the cathode assembly. When the height C of the entire assembly increases, the time for the cathode assembly 20 to reach a thermal state increases. That is, when the height C increases, the length of each of the holders 22, 23, and 24 increases so that loss of heat generated from a heater increases.

In particular, the values of D and C are determined based on a degree of coupling of the respective holders 22, 23, and 24 with respect to the insulation member 21. Here, during welding of the metal tape 40, the insulation member 21 directly receives a force by a welding rod. A strength (kg·f/mm$^2$) for generating cracks in the insulation member 21 when an external force is applied to the respective holders 22, 23, and 24 in the upper and lower directions are tested and the results of the tests are shown in the following Table 2.

TABLE 2

| D(mm)/C(mm) in percentage | 10% | 15% | 20% | 25% | 30% | 36% | 43% | 50% | 60% | 67% |
|---|---|---|---|---|---|---|---|---|---|---|
| Strength (kg · f/mm$^2$) | 3 | 5 | 6 | 7 | 10 | 15 | 16 | 18 | 20 | 20 |

As can be seen from the above table, when the value of D/C is less than or equal to 15%, since the strength is less than 5 kg·f/mm$^2$ applied during the welding, cracks are generated in the insulation member.

As shown in FIGS. 3 and 4, the height E is the distance from the end of the front protrusions 22*a*, 23*a*, and 24*a* to the support member 26. In the cathode assembly 20, it is preferable to set the length of each of the front protrusions 22*a*, 23*a*, and 24*a* protruding from the insulation member 21 to be less than or equal to the length of the rear protrusions 22*b*, 23*b*, and 24*b*, and it is preferable to set the height C of the entire cathode assembly and the height F of the support member 26 to satisfy an inequality, 29%≦F/C≦70%, so that a welding space of the holder is secured to perform welding between the holders 22, 23, and 24 and the metal tape 30 for applying an electric potential. When this inequality is expressed as a percentage, it is shown as 29%≦F/C≦70%. Otherwise, this inequality is shown as 0.29≦F/C≦0.70.

Here, by minimizing the width of the support member 26, the holders 22, 23, and 24 protruding from the rear surface of the insulation member 21 is formed to protrude over 1 millimeter (mm) from the end portion of the support member 26, so that an area for welding of the metal tape can be secured. Also, the screen display time is dominated by the thermal capacity of the support member 26 and the holders 22, 23, and 24. By setting the value of F/C as above, the screen display time can be reduced while the structural strength of the insulation member is maintained. The above effect will be clearer through experiments. The present inventor tested the strength of the insulation member 21 for supporting the holders 22, 23, and 24 and the screen display time and obtained the following results of Table 3.

TABLE 3

| F(mm)/C(mm) in percentage | 25% | 29% | 34% | 38% | 43% | 49% | 55% | 62% | 70% | 78% |
|---|---|---|---|---|---|---|---|---|---|---|
| Screen Display Time (sec) | 12.0 | 8.5 | 7.5 | 7.5 | 7.5 | 7.5 | 7.5 | 7.5 | 7.0 | 7.0 |
| Strength (kg · f/mm$^2$) | 5 | 8 | 10 | 12 | 14 | 15 | 14 | 11 | 8 | 4 |

As can be seen from Table 3, when the value of F/C is over 29%, the screen display time goes drastically faster from 12.0 sec to 8.5 sec and the structural strength of the insulation member 21 is maintained at 8 kg·f/mm$^2$. When the value of F/C is over 70%, it can be seen that the structural strength is sharply reduced.

A sleeve for supporting a base metal where electron emission substance is coated is fixed or suspended at each of the holders 22, 23, and 24 fixed to the insulation member 21 which is inserted in the support member 26 and fixed thereto.

Thus, in the cathode assembly 20 of an electron gun according to the present invention, unlike the conventional cathode assembly, a notch portion is not formed at the support member 26 for supporting the insulation member 21 so that the structural strength can be improved. Also, since the notch portion is not formed at the support member 26, the length of the support member 26 can be reduced and further the entire length of the electron gun installed at a neck portion of a funnel can be reduced.

Also, the diameter of each of the respective holders 22, 23, and 24 decreases due to thermal expansion during burning of the insulation member 21 where the holders 22, 23, and 24 are embedded. Since the holders 22, 23, and 24 have widened front protrusions 22*a*, 23*a*, and 24*a*, the sleeve can be easily inserted.

As described above, the cathode assembly according to the present invention and the electron gun for a color picture tube using the cathode assembly can secure a space for welding the metal tape without losing the structural strength of the cathode assembly. Also, the generation of cracks generated by a pressing force during welding of the metal tape and the small diametric portion of the respective holders can be fundamentally prevented.

While the present invention has been illustrated by the description of embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus and method, and illustrative examples shown and described. Accordingly, departures may be made from such details without departing from the spirit or scope of the applicant's general inventive concept.

What is claimed is:

1. A cathode assembly, comprising:

an insulation member having a thickness;

at least one holder being arranged inline in the insulation member; and a support member having a rim portion receiving and supporting said insulation member, said support member having a height, the height of said support member divided by the thickness of said insulating member being less than 1.70.

2. A cathode assembly, comprising:

an insulation member having a thickness measured in millimeters;

three holders being arranged inline in said insulation member; and a support member having a rim portion receiving and supporting said insulation member, said support member having a height measured in millimeters, the height of said support member divided by the thickness of said insulation member resulting in an amount less than 1.70.

3. The assembly of claim 2, said holders protruding from front and rear sides of said insulation member, said assembly having a total height measured in millimeters including said insulation member and said holders and said support member, the thickness of said insulation member divided by the total height of said assembly resulting in a value greater than 0.15.

4. The assembly of claim 2, said holders protruding from front and rear sides of said insulation member, said assembly having a total height C measured in millimeters including said insulation member and said holders and said support member, the thickness of said insulation member being D, the total height C and the thickness D satisfying 0.15≦(D/C)≦0.60.

5. The assembly of claim 2, said assembly having a total height C measured in millimeters, the height of said support member being F, the height F and the total height C satisfying 0.29≦(F/C)≦0.70.

6. The assembly of claim 2, each of said holders being supported by said insulation member, each of said holders having a front protrusion having a first length protruding from front side of said insulation member, each of said holders having a rear protrusion having a second length protruding from rear side of said insulation member opposite to the front side, the second length corresponding to one selected from among greater than the first length and equal to the first length.

7. A cathode assembly, comprising:

an insulation member having a thickness D measured in millimeters;

three holders arranged inline in said insulation member; and a support member having a rim portion, said insulation member being inserted into and supported by said rim portion, said support member having a height F measured in millimeters, said assembly having a total height C measured in millimeters, the total height C including a height of said holders and said insulation member and said support member, the height F and thickness D and total height C satisfying $0.29 \leqq (F/C) \leqq 0.70$ and satisfying $F/D<1.70$ and satisfying $0.15<D/C$.

8. An electron gun for a color tube, comprising:

a control electrode;

a screen electrode being installed adjacent to said control electrode;

a plurality of focus electrodes being installed adjacent to said screen electrode and forming an auxilliary lens and a main lens; and a cathode assembly being an electron emission source and being installed adjacent so said control electrode, with said control electrode being interposed between said cathode assembly and said screen electrode, said cathode assembly comprising:

an insulation member having a thickness D measured in millimeters;

three holders arranged inline in said insulation member; and a support member having a rim portion, said support member being inserted into and supported by said rim portion, said support member having a height F measured in millimeters, the height F of said support members divided by the thickness D of said insulation member resulting in an amount less than 1.70.

9. An electron emission apparatus, the apparatus comprising:

an insulation member having a thickness D measured in millimeters;

at least one holder being supported by said insulation member; and a support member receiving and supporting said insulation member, said support member having a height F measured in millimeters, the apparatus having a total height C measured in millimeters, the values of D and F and C satisfying at least one inequality selected from among $(F/D<1.70)$ and $(0.15 \leqq D/C)$ and $(D/C \leqq 0.60)$ and $(0.29 \leqq F/C)$ and $(F/C \leqq 0.70)$.

10. The apparatus of claim 9, said at least one holder corresponding to three holders arranged in line.

11. The apparatus of claim 9, said at least one holder having a front protrusion protruding from a front side of said insulating member and having a rear protrusion protruding from a rear side of said insulating member, said rear protrusion having a length being one selected from among longer than a length of said front protrusion and equal to the length of said front protrusion.

12. The apparatus of claim 11, said at least one holder corresponding to three holders arranged in line.

13. The apparatus of claim 12, the apparatus corresponding to a cathode assembly of an electron gun for a color picture tube.

14. A cathode assembly, comprising:

an insulation member having a thickness D measured in millimeters;

at least one holder being supported by said insulation member; and a support member receiving and supporting said insulation member, said support member having a height F measured in millimeters, the apparatus having a total height C measured in millimeters, the values of D and F and C satisfying $(F/D<1.70)$ and $(0.15 \leqq D/C)$ and $(D/C<0.60)$ and $(0.29 \leqq F/C)$ and $(F/C \leqq 0.70)$.

15. The assembly of claim 14, said at least one holder corresponding to three holders arranged in line.

16. The assembly claim 14, said at least one holder having a front protrusion protruding from a front side of said insulating member and having a rear protrusion protruding from a rear side of said insulating member, said rear protrusion having a length being one selected from among longer than a length of said front protrusion and equal to the length of said front protrusion.

17. The assembly of claim 16, the apparatus corresponding to a cathode assembly of an electron gun for a color picture tube.

18. The assembly of claim 17, said support member further comprising a rim portion supporting said insulating member, said support member forming an aperture penetrated by said front protrusion of said at least one holder.

19. The assembly of claim 18, said at least one holder corresponding to three holders arranged in line.

20. The assembly of claim 19, said holders being cylindrical in shape.

* * * * *